US006688014B1

(12) United States Patent
Allemand

(10) Patent No.: US 6,688,014 B1
(45) **Date of Patent: *Feb. 10, 2004**

(54) BUILDER'S MEASURING AND MARKING TOOL

(75) Inventor: Craig Allemand, Frankfort, IL (US)

(73) Assignee: Swanson Tool Co., Inc., Frankfort, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/105,359

(22) Filed: Jun. 26, 1998

(51) Int. Cl.[7] ..... B43L 13/00
(52) U.S. Cl. ..... 33/474; 33/429; 33/476
(58) Field of Search ..... 33/474, 429, 476, 33/481, 480, 483, 482, 451, 42, 415, 416, 417

(56) References Cited

U.S. PATENT DOCUMENTS

| | | | | | |
|---|---|---|---|---|---|
| 217,736 | A | * | 7/1879 | Kibbe | 33/474 |
| 233,203 | A | * | 10/1880 | Cushman | 33/483 |
| 434,073 | A | * | 8/1890 | Rondinella | 33/474 |
| 583,058 | A | * | 5/1897 | King | 33/474 |
| 610,286 | A | * | 9/1898 | Seat | 33/42 |
| 710,891 | A | * | 10/1902 | Pugh | 33/42 |
| 732,379 | A | * | 6/1903 | Shireman | 33/42 |
| 759,935 | A | * | 5/1904 | Swenson | 33/474 |
| 828,375 | A | * | 8/1906 | Breul | 33/42 |
| 1,619,427 | A | * | 3/1927 | McCaffery, Jr. | 33/474 |
| 2,652,629 | A | * | 9/1953 | Prucker, Jr. | 33/474 |
| 2,658,279 | A | * | 11/1953 | Amundsen | 33/451 |
| 4,171,573 | A | * | 10/1979 | Picciotto | 33/1 B |
| 4,404,753 | A | * | 9/1983 | Klok | 33/474 |
| 4,461,092 | A | * | 7/1984 | Hore | 33/474 |
| 4,503,624 | A | * | 3/1985 | Whiteford | 33/451 |
| 4,700,489 | A | * | 10/1987 | Vasile | 33/342 |
| 4,742,619 | A | * | 5/1988 | Swanson | 33/474 |
| 4,773,163 | A | * | 9/1988 | Wolford, Jr. | 33/474 |
| 4,926,564 | A | * | 5/1990 | Loggins | 33/474 |
| 4,999,922 | A | * | 3/1991 | Loggins | 33/474 |
| 5,012,590 | A | * | 5/1991 | Wagner et al. | 33/759 |
| 5,170,568 | A | * | 12/1992 | Wright | 33/480 |
| 5,253,426 | A | * | 10/1993 | Mosbrucker | 33/474 |
| 5,456,015 | A | * | 10/1995 | Butcher et al. | 33/474 |
| 5,509,213 | A | * | 4/1996 | Kelly et al. | 33/613 |
| 5,575,074 | A | * | 11/1996 | Cottongim et al. | 33/474 |
| 5,727,325 | A | * | 3/1998 | Mussell | 33/429 |
| D445,700 | S | * | 7/2001 | Mapston | D10/62 |
| 6,622,394 | B2 | * | 9/2003 | Werner et al. | 33/474 |

FOREIGN PATENT DOCUMENTS

| | | | | |
|---|---|---|---|---|
| DE | 3503920 A1 | * | 12/1985 | 33/474 |
| IT | 511868 | * | of 1955 | |

* cited by examiner

*Primary Examiner*—Christopher W. Fulton
*Assistant Examiner*—Mirellys Jagan
(74) *Attorney, Agent, or Firm*—Brinks Hofer Gilson & Lione

(57) ABSTRACT

A measurement or marking tool such as a roofer's square having a right triangular configuration'including a first straight edge having an abutment ledge therealong'a second straight edge extending at a right angle to the first straight edge, and a third straight edge forming the hypotenuse extending between the first and second straight edges'a linear measurement scale along the second straight edge and a diamond shaped aperture adjacent to the second straight edge located at a distance of three and a half inches from the intersection of the first and second straight edges'having a configuration and dimension to snugly receive the elongated lead point of a carpenter's pencil in such diamond shaped aperture to mark on a work piece such as a piece of lumber on which the tool or roofer's square is placed. The measurement and marking tool also includes an elongated aperture having elongated beveled side edges with measurement markings therealong'and a triangular aperture whose hypotenuse is substantially parallel to the elongated aperture and whose first and second sides forming a right angle are substantially parallel to respective ones of the first and second sides of the measurement and marking tool itself which form a right angle. The side edge of the triangular aperture which is parallel to the second side edge of the tool itself includes a plurality of notches. The side edge of the triangular

8 Claims, 3 Drawing Sheets

20
22
10
14
28
40
54
42
46
44
56
30
90
2
72
74
84
80
76
4
2
92
12
16
8
78
82
3
32
6
18

BUILDER'S MEASURING AND MARKING TOOL aperture which is parallel to the first side edge of the tool itself is beveled. the first side edge of the

FIELD OF THE INVENTION

This invention relates to the field of measuring and marking tools such as roofers'squares having a right triangle configuration comprising a first and second side which intersect at a right angle and a third side forming the hypotenuse, a ledge or T-bar along one of the first and second sides which projects above and below the upper and lower surfaces of the square, and with linear measurement and degree markings on both surfaces of the square along respective edge portions. In particular, this invention relates to such tools or squares in which positioning elements are provided to position the tool in selected marking positions and to hold marking pencils in position for marking lumber to be cut for rafters and other parts of the roofing or construction framework.

BACKGROUND OF THE INVENTION

A number of builder's measurement and marking tools such as roofing squares of the right triangle type are known to the prior art. Those known to the inventor herein are shown and described in the following United States patents which are readily available to the public in a number of locations throughout the United States: U.S. Pat. Nos. 4,513,510 and 4,742,619 both of which have been assigned to the assignee of the present invention described herein,and the patents cited in those cases which are; U.S. Pat. Nos. 175,113; 183,387; 864,096; 1,001,316; 1,014,453; 2,805,484; 3,623,232; 4,244,105; 265,383; 437,870; 1,249,132; 2,076,300; and 3,178,826.

SUMMARY OF THE INVENTION

The builder's measurement and marking tool in accordance with a preferred embodiment of the present invention has a right triangle configuration, comprising a first and second side edge which intersect at a right angle and a third side edge which forms the hypotenuse. A T-bar extends along the first side edge and projects upwardly about a quarter inch from the upper surface of the square as well as downwardly about a quarter inch from its lower or downwardly facing surface. A linear scale in inches is provided along the second side edge, starting at the intersection of the first and second side edges with markings at eighth of an inch and numerals starting with the number one to indicate each inch. Such markings are provided along the second side edge on both oppositely facing surfaces of the square. The wall portion of the second side edge between the upper and lower surfaces of the square is smooth and planar to permit use as a straight edge for sliding a pencil therealong to mark a straight line. A diamond shape aperture is provided, with one of its points at the three and a half inch mark of the aforesaid markings along the second side edge, which is three and half inches from the T-bar along the first side edge. This is the width of a conventional two by four piece of lumber and is thus useful for marking such distance on pieces of lumber for use in roof construction and other types of building construction. The diamond configuration of the aperture provides sufficient space for the elongated lead point of a carpenter's pencil to extend through the square to mark on the surface of the piece of lumber below, and it holds such elongated lead point steady while the workman slides the square with pencil in place along the surface of the work piece being marked.

One particularly advantageous use of the diamond shaped aperture of this invention is in marking out seat cuts, or "birdsmouths," on lumber to be used for rafters. The term "birdsmouth" is commonly used in the trade to indicate the triangular cut-out portion of a rafter which seats on the ridge plate of the building wall, with one side edge of the cut-out extending vertically in abutment against the vertical side wall of the ridge plate and the other side edge of the cut-out extending horizontally resting on and against the upwardly facing, horizontally extending surface of the ridge plate, while the rafter itself extends upwardly from the ridge plate at a pre-determined diagonal.

To mark the birdsmouth on a piece of lumber to be used for a rafter using the square with the diamond aperture in accordance with this invention, a plumb line is first marked on the piece of lumber at a desired distance in from the lower rafter end depending on the overhang desired. The plumb line extends vertically when the piece of lumber is positioned to extend at the desired pre-determined diagonal The square is then placed on the piece of lumber with the T-bar along the first side edge of the square abutting against a side of the piece of lumber or work piece in which the birdsmouth is to be cut at which time the second side edge of the square having the diamond shaped aperture at its three and a half inch location extends inwardly of such work piece. A workman can then slide the square along such side edge of the work piece, until the diamond shaped aperture intersects the plumb line. The square is then rotated with the diamond shaped aperture over the plumb line until the plumb line intersects the opposite points of the diamond shaped aperture which lie on an imaginary line that extends normal to the second side edge of the square. The straight second edge of the square thus extends at a ninety degree angle from the plumb line, along which a cut-out line can be marked on the work piece from the plumb line to the side edge of the work piece. The birdsmouth can then be cut first along the plumb line from the side edge of the work piece to its intersection with the cut-out line, after which a second cut can be made in the work piece along the said cut-out line from its side edge to the plumb line and to the end of the first cut therealong.

DESCRIPTION OF PREFERRED EMBODIMENT

Figure 1:
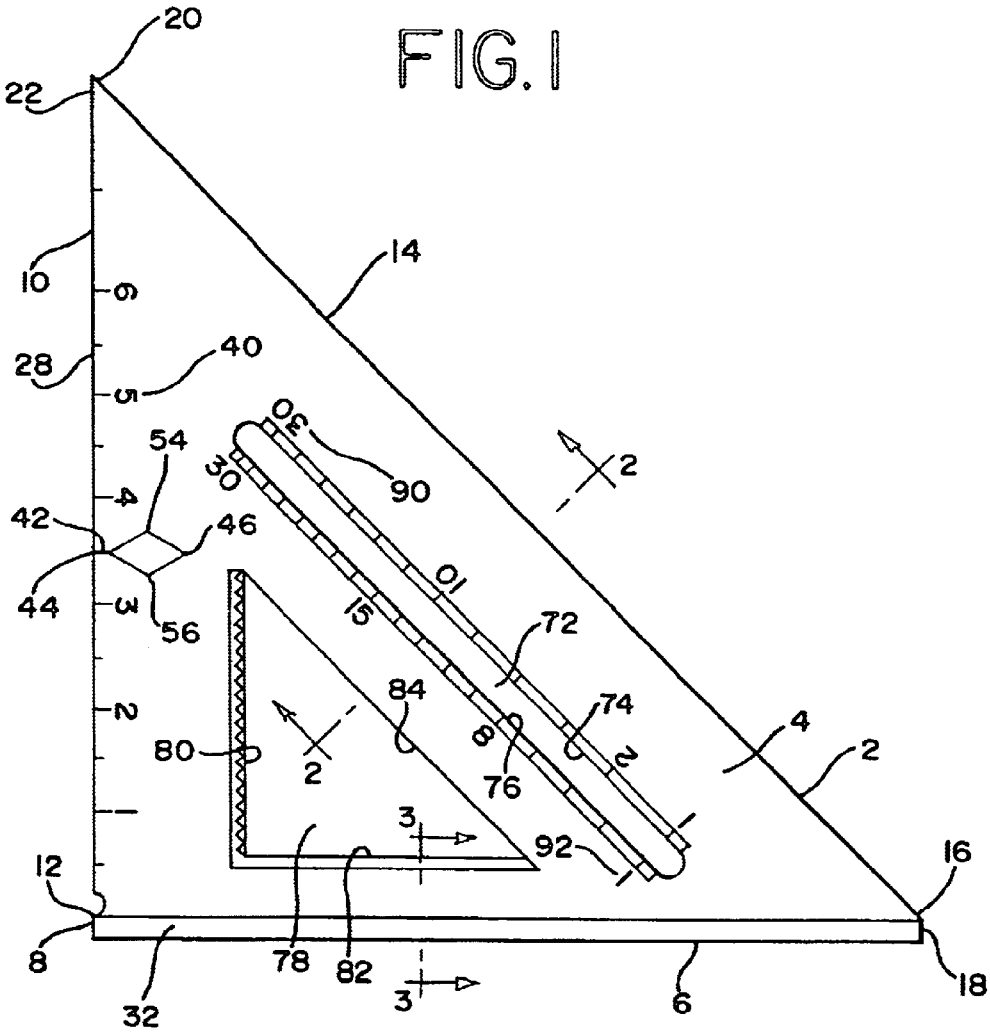
FIG. 1 is a plan view of a builde's measurement and marking tool in accordance with this invention.
Figure 4:
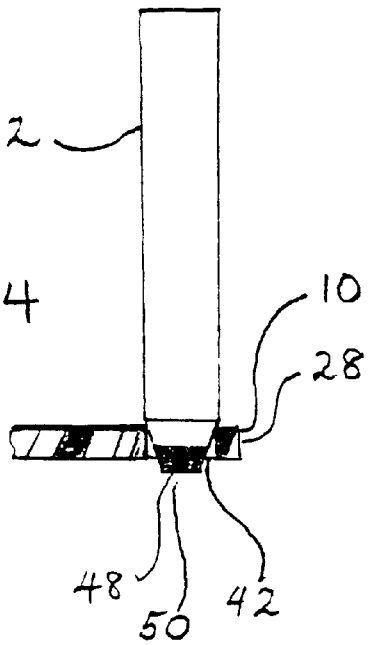
FIG. 4 is a section view of the diamond shaped aperture of the tool taken on the longitudinal axis of the aperture showing the elongated lead point of a carpenter's pencil snugly received therein and extending therethrough for marking on a work piece on which the measurement and marking tool is placed.
Figure 5:
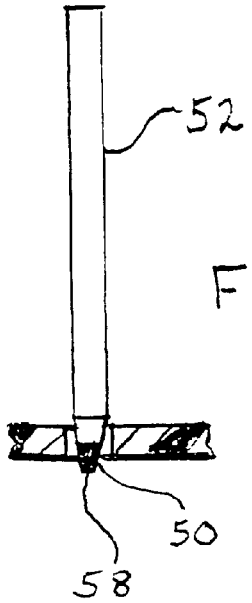
FIG. 5 is a section view of the diamond shaped aperture of the tool taken on the lateral axis of the aperture showing the lateral dimension of the lead point of a carpenter's tool snugly received in the aperture and extending therethrough for marking on a work piece on which the measurement and marking tool is placed.

A builder's measurement and marking tool 2 in accordance with this invention comprises a planar member 4 having a right triangle peripheral configuration, sometimes referred to as a roofer's square, including a first side edge 6 having a first end 8 which intersects at a right angle with a second side edge 10 at its first end 12, and a third side edge 14 forming the hypotenuse of the right triangle square 2 intersected at one end 16 by the first side edge 6 at its opposite end 18, and at the opposite end 20 of the hypotenuse or third side edge 14 by the second side edge 10 at its opposite end 22.

The measurement and marking tool 2 has a first planar surface 24 facing in one direction and a second planar surface 26 facing in the opposite direction, such surfaces being parallel and spaced apart a short distance off about three-sixteenths to a quarter of an inch. A first smooth straight edge wall surface 28 extends between such planar surfaces along the said second side edge 10 to provide a marking edge along which a pencil can be drawn to mark a straight smooth line. A second smooth straight edge wall surface 30 extends between the planar surfaces along the third side edge 14 to also provide a smooth marking edge along that side of the tool or square 2.

A T-bar 32 is provided along the first side edge 6, having a first ledge 34 with a planar surface extending outwardly a short distance of about a fourth of an inch from and normal to the first planar surface 24 facing inwardly theretoward, and a second ledge 36 with a planar surface extending outwardly a short distance of about a fourth of an inch from and normal to the second oppositely facing planar surface 26 facing inwardly theretoward. The T-bar 32 has an oppositely facing planar surface 38 facing outwardly and away from the tool or square.

A first measurement scale 40 in inches is marked and integrally formed in both the, first planar surface 24 and second planar surface 26 along the second side edge 10, starting from its end. 12 adjacent end 8 of first side edge 6, such scale being marked in eighth of an inch increments and with numerals to indicate each successive inch beginning with the numeral 1 to indicate the first inch away from end 8 of the first side edge 6.

A diamond shaped aperture 42 is formed in and extends through the measurement and marking tool 2 from its first planar surface 24 to its second planar surface 26 along the said second side edge 10 at the location of the three, and a half inch mark. The diamond shaped-aperture 42 includes a first point 44 directed at the three and a half inch mark and is inwardly from the second side edge 10 a short distance of about one-eighth of an inch. A second point 46 of the diamond shaped aperture 42 is directly, opposite from and spaced apart from the first point 44 a distance of about three-eighths of an inch, which corresponds to the elongated dimension 48 of the elongated lead point 50 of a carpenter's pencil 52. The lead point 50 can thus be extended into and through the diamond shaped aperture 42 to mark on a work piece below and on which the tool or square 2 in accordance with this invention has been placed. The diamond shaped aperture 42 also includes third point 54 and fourth point 56, midway between the first point 44 and second point 46 and spaced apart outwardly an equal distance in opposite directions from a straight line between first point 44 and second point 46. Points 54 and 56 are spaced apart a distance to provide a diamond shaped aperture-area 42 which corresponds in size to the lateral dimension 58 of the lead point 50 of the carpenter's pencil 52. Points 54 and 56 are thus spaced apart a distance of about one-eighth to two-eighths of an inch. The lead point 50 of the carpenter's pencil 52 is held snugly when received in the diamond shaped aperture 42 to make a straight, non-wavering pencil mark, when inserted and a workman draws the square 2 along a work piece wit-h the T-bar 32 sliding along the edge of the work piece to serve as a guide.

The location of the diamond shaped aperture 42 at the three and a half inch point of the second side edge 10 was selected to correspond to the width of standard two by four pieces of lumber, which is three and a half inches. It is often necessary in the roofing and construction industry to mark work pieces at a point or along a line that corresponds to the width dimension of standard two by fours. One particularly advantageous use of the measurement and marking tool 2 in accordance with the present invention having the diamond shaped aperture as described is in marking triangular seat cuts in work pieces to be used as rafters, such seat cuts commonly referred to in the trade as birdsmouths. These are the cut-outs which receive and rest on the ridge plate of the wall when the rafter is put in place. A plumb line 60 is first drawn on the piece of lumber 62 to be made into a rafter, representing the vertical when the rafter is in place extending upwardly on a diagonal from the ridge plate of the wall at the desired angle.

The tool or square 2 is placed on the work piece 62 with its T-bar 32 along the side edge 64 of the work piece 62 in which the, birdsmouth 66 is to be cut. The second side edge 10 of the square 2 then extends inwardly of the work piece which positions the diamond shaped aperture 42 inwardly a distance of three and a half inches that corresponds to the width of a standard two by four. The workman slides the tool or square 2 along the edge 64 of the work piece 62 until the diamond shaped aperture 42 overlays the plumb line 60. The square 2 is then pivoted with the diamond shaped aperture 42 over the plumb line 60 until the plumb line 60 intersects the two points 44 and 46 of the diamond shaped aperture 42.

When the square 2 is pivoted to such position, its straight edge 10 then extends at a right angle-to the plumb line 60. A cut-out line 70 is then drawn along the straight edge 10 from the plumb line 60 to the edge 64 of the work piece 62. Such cut-out line 70 extends at a right angle to the plumb line 60. The birdsmouth 66 may then be cut out on the cut-out line 70, and on the plumb line 60 from the edge 64 of the work piece 62 to its intersection point with the aforesaid cut-out line 70. When done this way, the portion of the birdsmouth 66 along the plumb line 60 will be in vertical abutment with the vertical side of the ridge plate and the portion cut out along the cut-out line 70 will be in horizontal abutment resting on the horizontal surface of the ridge plate when the rafter extends therefrom in its correct diagonal position at the desired angle.

The square or measurement and marking tool 2 in accordance with this invention also includes an elongated aperture 72 -bounded by parallel beveled straight edges 74 and 76 spaced apart about a fourth of an inch and extending about six inches in length.

Degree markings 90 and 92 are formed in the tool or square on both the first surface 24 and the opposite second surface 26 along both side edges 74 and 76 of elongated aperture 72. This aperture is parallel to the third side edge 14 of the square 2 and spaced apart inwardly therefrom about an inch and a quarter.

The square or tool 2 also includes a triangular aperture 78 in the form of a right triangle, having a first side edge 80 which intersects a second side edge 82 at a right angle, and a third side edge 84 representing the hypotenuse. The hypotenuse or third side edge 84 is parallel to the side edges 74 and 76 of the elongated aperture 72, and spaced apart from side edge 76 a distance three-fourths of an inch.

Figure 3:
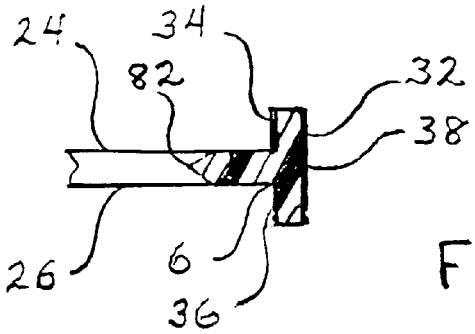
FIG. 3 is a section view taken on line 3—3 of FIG. 1.
Figure 2:
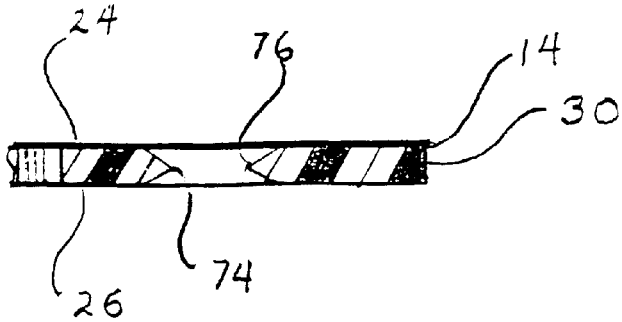
FIG. 2 is a section view taken on line 2—2 of FIG. 1.
Figure 6:
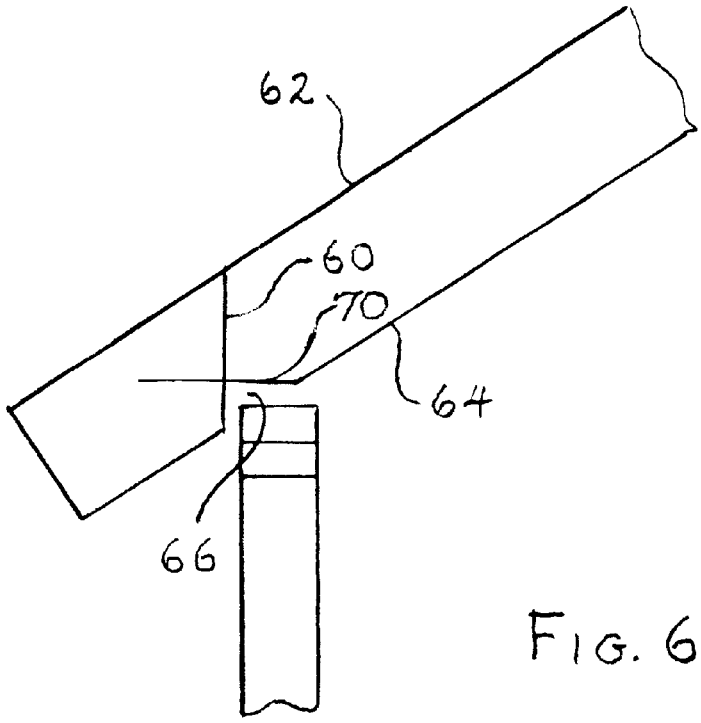
FIG. 6 is an elevation view of a rafter in position for seating on the ridge plate of a wall, having a seat cut-out or birdsmouth to receive the ridge plate when seated thereon.

The first side edge 80 of the triangle aperture 78 is parallel to the second side edge 10 of the tool or square 2, and spaced apart inwardly thereof about one and a half inches. Side edge 80 is about two and a half inches long and is serrated, having nineteen notches formed therein. The second side edge 82 of the triangular aperture 78 is parallel to the first side edge 6 of the tool 2, and spaced apart inwardly therefrom about three-fourths of an inch. This side edge 82 is beveled and smooth to provide a straight edge for marking therealong with a pencil or other marking instrument. This beveled side edge 82 converges to a point as its beveled portion extends from the first planar surface 24 toward the second planar surface 26 as seen in FIG. 3. Linear markings in inches are formed in both opposite surfaces of the square 2 along side edge 82, starting with a mark representing an inch and a half from the second side edge 10 of the tool 2 and extending to the four inch mark at the end of side edge 82 which is four inches from the second side edge 10 of the tool 2.

I claim:

1. A method of marking a seat cut on a work piece using a builder's measuring and marking tool comprising a planar member having a first straight edge, a second straight edge extending normal to said first straight edge, abutment means along said first straight edge for abutting against a work piece when said second straight edge is positioned to extend over the work piece, said planar member including an elongated aperture extending through said planar member and positioned near said second straight edge at a predetermined distance from said first straight edge corresponding to a width of a standard piece of lumber, said elongated aperture having a longitudinal dimension between a first point and a second point extending on a line that is substantially normal to said second straight edge, said method comprising:

drawing a plumb line on said work piece;

placing said builder's measuring and marking tool on said work piece with said abutment means along a side edge of said work piece;

sliding said builder's measuring and marking tool along said side edge of said work piece until said elongated aperture overlays said plumb line;

pivoting said builder's measuring and marking tool until said plumb line intersects said first point and said second point of said elongated aperture; and marking a seat cut line along said second straight edge of the tool from said plumb line to said side edge of said work piece.

2. The method of claim 1 wherein said predetermined distance of said elongated aperture from said first straight edge is substantially three and a half inches.

3. The method of claim 1, wherein said first point is spaced about one-eighth of an inch inwardly from said second straight edge.

4. The method of claim 1 wherein said abutment means comprises an elongated ledge extending along said first straight edge.

5. The method of claim 1 wherein said second point is spaced apart about three-eighths of an inch inwardly from said first point, such that said longitudinal dimension between said first point and said second point corresponds to an elongated dimension of a lead point of a carpenter's pencil.

6. The method of claim 5 wherein said elongated aperture has a lateral dimension corresponding to a lateral thickness of said lead point of said carpenter's pencil, said lateral dimension being no greater than about one-fourth of an inch, said elongated aperture having a peripheral edge encompassing said lateral and longitudinal dimensions thereof enabling portions of said peripheral edge to contact and bear against portions of said elongated lead point of said carpenter's pencil to hold said pencil steady when received in said elongated aperture.

7. The method of claim 6 wherein said elongated aperture includes the configuration of a first lateral point and, of a second lateral point, said lateral points being located midway between said first point and said second point of said elongated aperture, each of said first and second lateral points spaced apart a substantially equal distance from, and on opposite sides of, a straight line between said first and second points of said elongated aperture.

8. The method of claim 7 wherein said elongated aperture is in the shape of a diamond.

* * * * *